US008635738B2

(12) United States Patent
Zita

(10) Patent No.: US 8,635,738 B2
(45) Date of Patent: Jan. 28, 2014

(54) DUSTING SYSTEM

(75) Inventor: Johann Zita, Gustavsberg (SE)

(73) Assignee: AB Electrolux (SE)

( * ) Notice: Subject to any disclaimer, the term of this patent is extended or adjusted under 35 U.S.C. 154(b) by 0 days.

(21) Appl. No.: 13/517,451

(22) PCT Filed: Dec. 17, 2010

(86) PCT No.: PCT/SE2010/000307

§ 371 (c)(1),
(2), (4) Date: Jun. 20, 2012

(87) PCT Pub. No.: WO2011/078759

PCT Pub. Date: Jun. 30, 2011

(65) Prior Publication Data

US 2013/0031741 A1 Feb. 7, 2013

Related U.S. Application Data

(60) Provisional application No. 61/289,895, filed on Dec. 23, 2009.

(30) Foreign Application Priority Data

Dec. 22, 2009 (SE) ..... 0901596

(51) Int. Cl.

| | |
|---|---|
| ***A47L 5/26*** | (2006.01) |
| ***A47L 5/38*** | (2006.01) |
| ***A47L 9/06*** | (2006.01) |

(52) U.S. Cl.

USPC ..... 15/310; 15/328; 15/339; 15/347; 15/352; 15/393; 15/394; 15/403

(58) Field of Classification Search

USPC ..... 15/347, 352, 310, 328, 339, 393, 394, 15/403

IPC ..... A47L 5/26,5/38, 9/06

See application file for complete search history.

(56) References Cited

U.S. PATENT DOCUMENTS

| | | | | |
|---|---|---|---|---|
| 5,887,314 | A * | 3/1999 | Jordan, Jr. | 16/405 |
| 7,024,723 | B2 | 4/2006 | Vandenbelt et al. | |
| 2001/0002499 | A1 * | 6/2001 | Lindquist et al. | 15/310 |
| 2006/0096055 | A1 * | 5/2006 | Rodberg et al. | 15/310 |

FOREIGN PATENT DOCUMENTS

| | | | |
|---|---|---|---|
| EP | 1106131 | A2 | 6/2001 |
| JP | 2008136710 | A | 6/2008 |
| KR | 19990073351 | A | 5/1999 |
| WO | 02054930 | A1 | 7/2002 |

* cited by examiner

*Primary Examiner* — David Redding
(74) *Attorney, Agent, or Firm* — RatnerPrestia

(57) ABSTRACT

This invention relates to a dusting system (1) comprising a dusting tool (20) with a cleaning portion (21) connected to a handle (22), and an elongated chamber (10) for holding the dusting tool. The chamber comprises a storage compartment (15) arranged for storing at least a part of the cleaning portion as the dusting tool is inserted into the chamber, and a cleaning compartment (11) arranged between the opening (13) of the chamber and the storing compartment (15). Further, an outlet channel (12) is arranged for enabling fluid communication between the chamber and a vacuum source. The outlet channel is arranged at the cleaning compartment, thereby enabling a cleaning of the cleaning portion upon insertion or extraction of the cleaning portion into or from the storage compartment. The system may be a self standing unit or be integrated into a vacuum cleaner.

20 Claims, 5 Drawing Sheets

DUSTING SYSTEM

This application is a U.S. National Phase application of PCT International Application No. PCT/SE2010/000307, filed Dec. 17, 2010 and claims priority to Swedish Patent Application No. 0901596-7 filed Dec. 22, 2009, and the benefit of U.S. Provisional Application No. 61/289,895 filed Dec. 23, 2009.

FIELD OF THE INVENTION

The present invention relates to a dusting system comprising a chamber for holding a dusting tool, which chamber is connectable to a vacuum source.

BACKGROUND OF THE INVENTION

The use of traditional dusting tools, like feather dusters, still has its place in modern homes. The need for dusting off surfaces which are not directly suitable for vacuum cleaner nozzles or brush nozzles on the vacuum cleaner tube handle, like fragile furniture, book shelves and other types of objects. These surfaces require a more delicate dusting, which works in the feather dusters favor. Previously, the feather duster was typically utilized to collect dust and was then cleaned by going outside and shaking or brushing the dust off. However, more effective ways of attending to the cleaning off of the dusting tool have been developed. Dusting systems comprising a dusting tool, like a feather duster, and a corresponding chamber for holding the dusting tool, and which chamber is further connected to a vacuum source are known. These types of dusting systems have the advantage of clearing away dust that has been collected in the dusting tool by means of the vacuum source as the dusting tool is stored in chamber. A system of this kind is shown in EP 1,106,131 A2, which discloses a device for a vacuum cleaner comprising a holder for a dust pick up tool, such as a feather duster. The holder has a chamber which is connectable with an inlet or outlet channel of a vacuum source, such that when the dust pick up tool is in the chamber, it is cleaned by means of air flowing through the chamber.

SUMMARY OF THE INVENTION

It is an object of the present invention to provide an alternative dusting system which provides an improved ability to clear away dust from the dusting tool.

This object is achieved by a dusting system according to the present invention as defined in the independent claims.

Thus, in accordance with an aspect of the present invention, there is provided a dusting system comprising a dusting tool with a cleaning portion connected to a handle, and an elongated chamber for holding the dusting tool. The chamber comprises an opening for receiving at least the cleaning portion, an outlet channel arranged for enabling fluid communication between the chamber and a vacuum source, and a storage compartment for storing at least a part of the cleaning portion. The chamber further comprises a cleaning compartment arranged between the opening and the storage compartment. The outlet channel is arranged at the cleaning compartment, thereby enabling cleaning of the cleaning portion upon insertion or extraction of the cleaning portion into or from the storage compartment. Further, the dusting tool comprises a first closing element arranged at the handle, which first closing element is arranged to engage with the opening providing an air seal for the chamber.

Thereby a dusting system is provided in which the dusting tool is efficiently cleaned in the cleaning compartment of the chamber, as the cleaning portion is extracted from or reinserted into the chamber for storage in the storage compartment. The suction force provided by means of a vacuum source which is connected to the outlet channel is thus concentrated to a restricted volume near the air inlet, which is provided by means of the opening of the chamber. This has the effect that only a subpart of the dusting tool is cleaned at each moment of the insertion or extraction of the cleaning portion. Via the outlet channel, the dusting system may be connected to an external vacuum source or be provided with its own fan unit, and optionally a dust collector, to form a free-standing and optionally mobile dusting system. Furthermore, air is stopped by the first closing element from leaking into the chamber and further through the outlet channel. This decreases the sound from the vacuum source when the dusting tool is positioned in the storage compartment. Further, when employing the dusting system in a vacuum cleaner, it is important to seal off the air flow via the opening of the chamber and instead concentrate the air flow inlet to the vacuum cleaner nozzle in order to provide maximum cleaning performance when the dusting tool is stored in the chamber.

In accordance with an embodiment of the dusting system, the chamber is arranged such that a predetermined ratio between the cross-sectional area in a plane perpendicular to the extension of the chamber for the cleaning compartment and for the storage compartment, respectively, is larger than 1.

The cross-sectional area of the cleaning compartment may be arranged to be constant over its entire length. The chamber is in this way arranged to avoid undesired air streams which may cause disturbing sounds during insertion and extraction of the dusting tool.

Further, the chamber is preferably arranged having a cross-sectional area of a size allowing the cleaning portion material to move freely while being subjected to the suction force from the vacuum source.

In accordance with an embodiment of the dusting system, the chamber further comprises a dust releasing structure. The dust releasing structure is arranged to create obstacles for the cleaning portion during insertion and extraction from the chamber, such that dust and particles are mechanically released from the cleaning portion for further transportation in the dust laden airstream out from the cleaning compartment. The dust releasing structure may be arranged e.g. along at least a part of the inner wall of the cleaning compartment and arranged to protrude a predetermined portion into the void of the cleaning compartment, or at the outlet channel.

In accordance with an embodiment of the dusting system, the dust releasing structure is a grid arranged at least partly covering the entry from the cleaning compartment to the outlet channel. Arranging the dust releasing structure directly at the outlet channel facilitates the removal of released dust and particles by means of the airstream created by the vacuum source. The grid may be arranged with elements protruding a predetermined portion into the cleaning compartment, and preferably towards the centre of the cleaning compartment.

In accordance with an embodiment of the dusting system, the storage compartment is arranged to compact the cleaning portion. This provides high friction between the cleaning portion and the walls of the storage compartment during insertion and extraction of the dusting tool from the chamber. The dusting tool is then kept in place when being in the storage compartment. Further, when the cross-sectional area for the storage compartment is sufficiently small to compress the cleaning portion, the cleaning compartment is more efficiently sealed off from the storage compartment, such that the suction force from the vacuum source is concentrated to the cleaning compartment.

In accordance with an embodiment of the dusting system, the materials for the storage compartment or its inner surface, and the cleaning portion are selected for providing charging of the cleaning portion with static electricity, which increases the ability of the dusting tool to attract and contain dust during use.

In accordance with an embodiment of the dusting system, the first closing element is cone shaped, which is advantageous for providing an efficient air sealing of the inlet.

In accordance with an embodiment of the dusting system, the chamber further comprises a transparent window. By arranging at least a portion of the chamber in a transparent material a visual indication for the user that the dusting tool is available and clean is provided.

In accordance with an embodiment of the dusting system, the outlet channel is adapted to be connectable with a vacuum cleaner hose, a vacuum cleaner tube, or a vacuum cleaner handle which is advantageous.

In accordance with an embodiment of the dusting system, the chamber further comprises a second closing element for providing an air seal for the chamber when the dusting tool is detached from the chamber. The second closing element is arranged to engage with the opening when being actuated, which has the same advantages as described above for the first closing element.

In accordance with an embodiment of the dusting system, the chamber is adapted to be arranged in a vacuum cleaner housing of a vacuum cleaner. The outlet channel is adapted to be connectable with a dust bag or directly to a cyclone unit of the vacuum cleaner.

In accordance with an embodiment of the dusting system, the handle is telescopically extendable, such that the dusting tool may be completely contained within the chamber when being stored, while still providing a sufficiently long handle during use.

In accordance with an aspect of the invention, there is provided a vacuum cleaner comprising a dusting system according to the invention. Implementation of the dusting system in a vacuum cleaner is in addition to the advantages as explained above, convenient to the user as this offers flexibility during cleaning. The user is provided with the options of using the dusting tool or using the vacuum cleaner hose and nozzle, depending on the current surface or object to clean. The vacuum cleaner may be of any kind of suitable vacuum cleaner, e.g. a canister vacuum cleaner, a bagged or bag less vacuum cleaner, an upright vacuum cleaner, or a central vacuum cleaner.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1A:
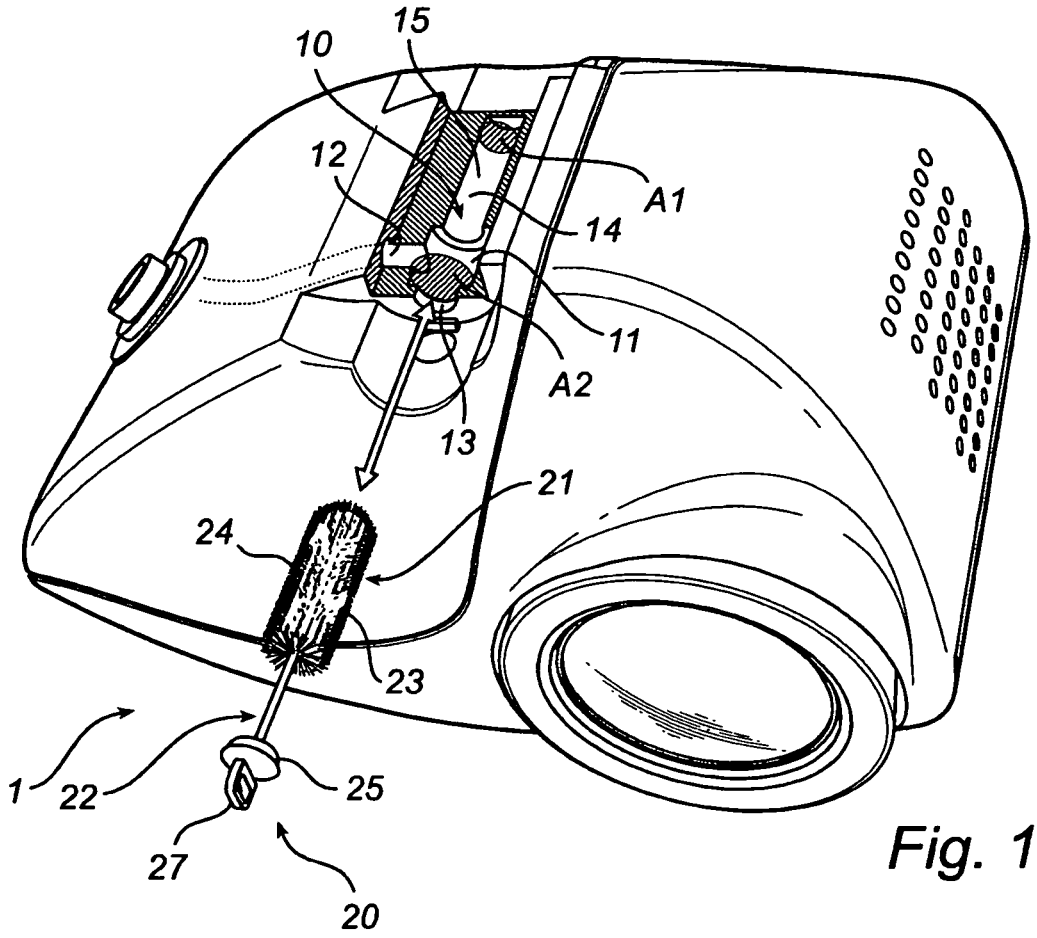
FIGS. 1*a*) and *b*) are schematic perspective partly cut open views illustrating an embodiment of the dusting system according to the present inventive concept, and *c*) is a close up showing a detail of an embodiment of the present inventive concept.

Embodiments according to the present inventive concept will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

A schematic perspective partly cut open view illustrating an embodiment of a dusting system according to the present inventive concept is presented in FIG. l*a*). The embodiment is arranged in a vacuum cleaner, however it should be noted that the system may be arranged as a self standing unit. The dusting system 1-, comprising a dusting tool 20 and a corresponding chamber 10, is shown with the dusting tool 20 fully extracted and being outside the chamber 10. The dusting tool is, in this exemplifying embodiment, a feather duster. The dusting tool 20 has a handle 22 onto which an elongated dusting portion 21, comprising a fiber holder 23 and a fiber unit 24, is arranged. The fiber unit 24 comprises fibers suitable for collecting dust. The fiber unit 24 may be permanently fixated to the fiber holder 23, e.g. as long fibers twinned together with steel wire to form the dusting portion 21. However, the fiber unit may in alternative embodiments be removable and/or exchangeable. The dusting portion 21 may in other embodiments be realized as one piece.

The chamber 10 is arranged to fit the dusting portion 20, and is elongated and provided with a central opening 13, into which the dusting tool is inserted when entering the chamber 10. The chamber 10 further comprises a cylinder shaped cleaning compartment 11, having an outlet 12 for facilitating fluid communication between the chamber 10 and a vacuum source, which here is the vacuum source of the vacuum cleaner (not shown). The vacuum source may be an external vacuum source, i.e. a central vacuum cleaner to which the dusting system is connected, or be provided by means of a fan unit and a dust collector as an integrated part of the dusting system, such that a free-standing and optionally mobile dusting system is provided.

Further, the chamber 10 comprises a cylinder shaped storage compartment 15 arranged in a first end in connection to the cleaning compartment 11 and opposite to the opening 13, and which is closed in a second end. The chamber 10 is further arranged such that the cross-sectional area A2 of the cleaning compartment 11 , in a plane perpendicular to the extension of the chamber 10, is sufficiently large to allow the fibers of the cleaning portion 21 to move freely. Due to this removing of dust and particles from the part of the cleaning portion 21 which is present in the cleaning compartment 11 and being subjected to the suction force provided by the vacuum source is facilitated. To continue, the cross-sectional area Al of the storage compartment 15 is smaller than the cross-sectional area A2 of the cleaning compartment 11. This results in that the cleaning portion 21 is compressed as it is inserted in the storage compartment 15, as depicted in FIG.l*b*).

The cross sectional profile of the cleaning compartment is preferably kept as smooth as possible, and is arranged having the same diameter along the whole length of the cleaning compartment 11, to avoid turbulent air streaming and creation of unwanted sounds as air is flowing through the cleaning compartment 11.

Figure 1B:
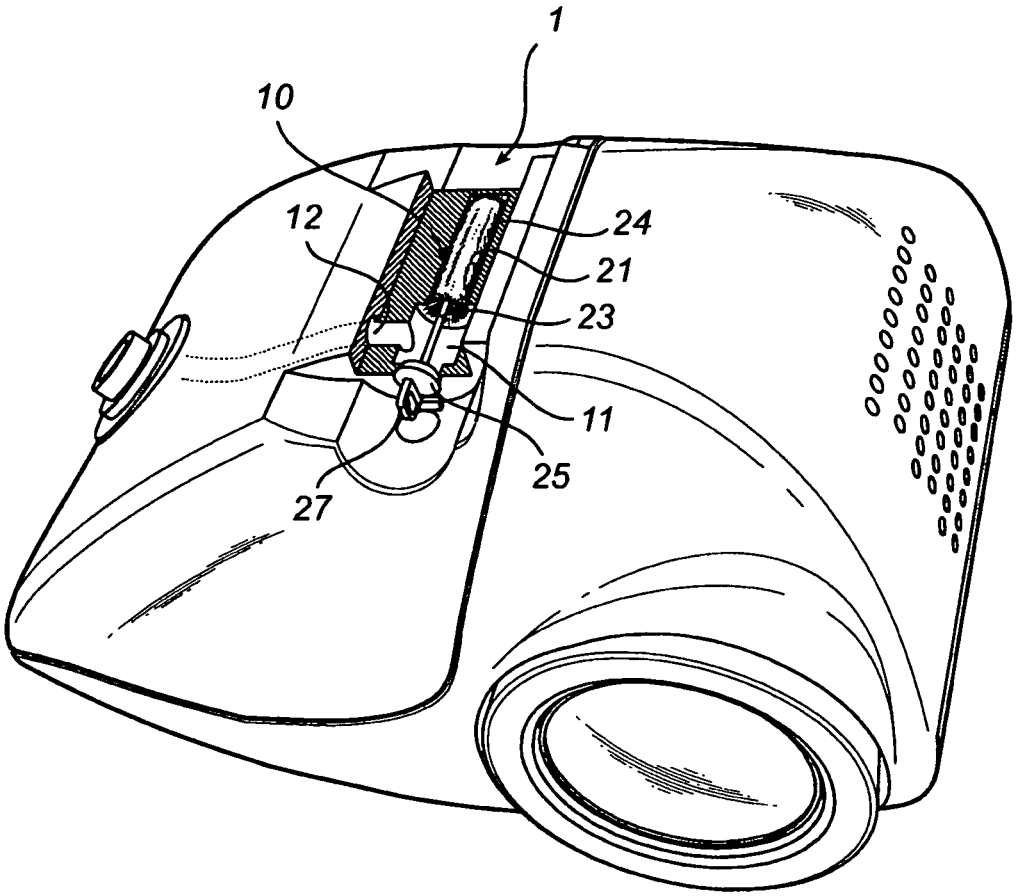
Figure 1C:
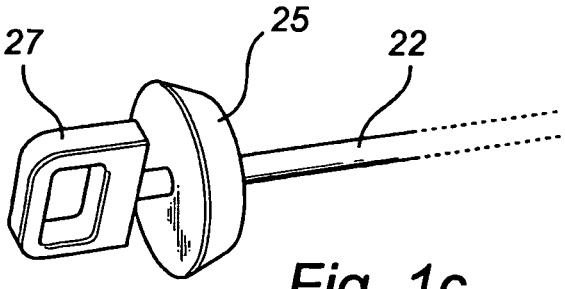

A first closing element 25 is formed to provide an air seal for the chamber 10 when the dusting tool 21 is in an inserted position. The first closing element 25 is here a plate shaped as a truncated cone arranged on the handle 22 of the dusting tool 20. Hence, when the dusting tool 20 is fully inserted into the chamber 10, the opening 13 is sealed off and no air can enter the chamber 10 via the opening 13. In FIG. 1 *b*), the first closing element 25 is inserted in the opening 13. As illustrated in the close up of the handle 22 in FIG. 1*c*), the handle 22 has a grip 27 and a cone shaped first closing element 25. The conical surface of the first closing element 25 provides a good air sealing between the dusting tool and the chamber 10. However, other shapes of the first closing element are possible and are preferably adapted to the shape of the opening of the chamber to provide good air sealing of the chamber.

Figure 2:
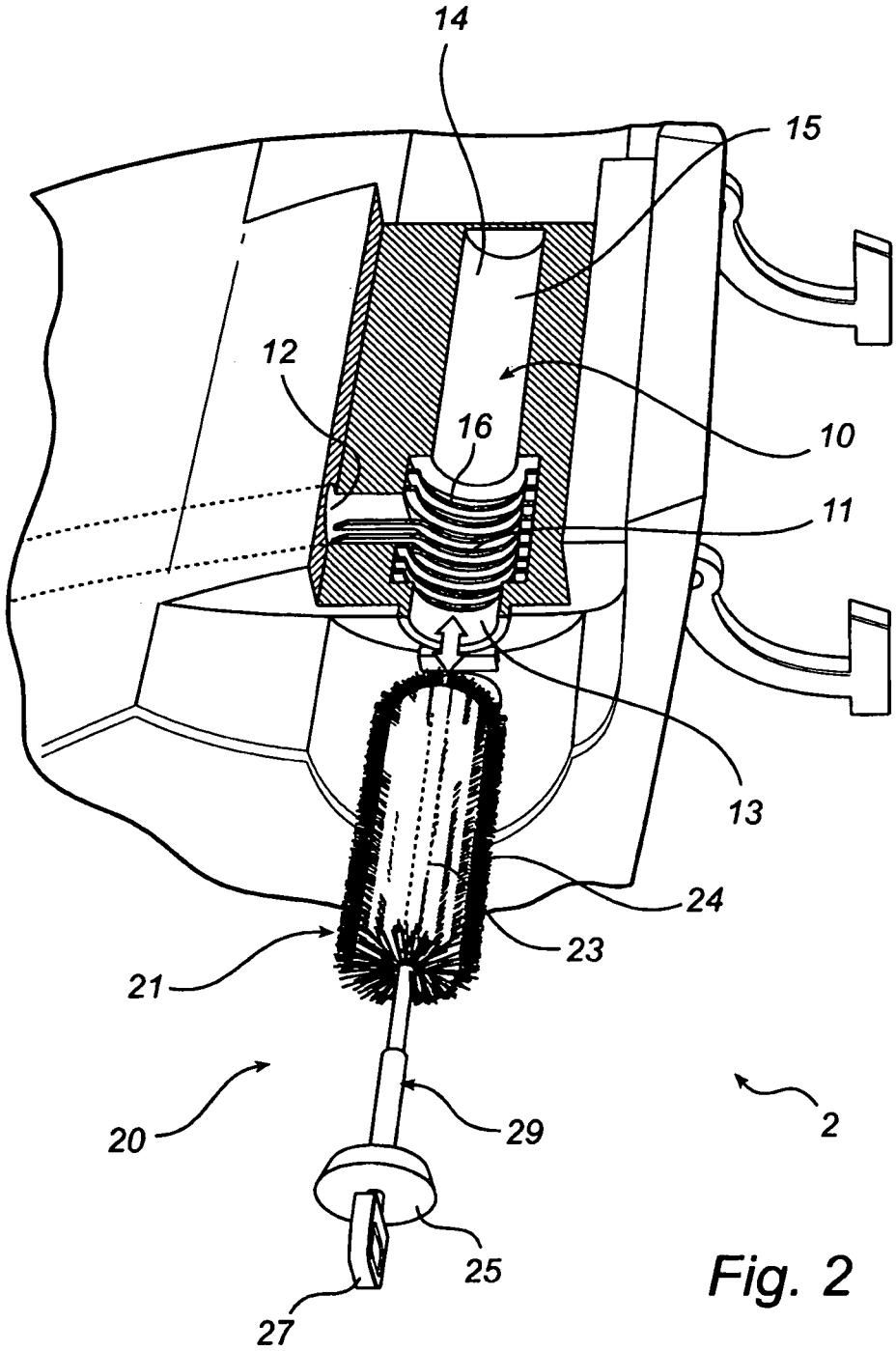
FIG. 2 is a schematic perspective partly cut open view illustrating an embodiment of the dusting system according to the present inventive concept.

In an embodiment of a dusting system according to the present inventive concept, as illustrated in FIG. 2, there is provided a dusting tool 20 which is arranged having a handle 22 with a telescopic part 29 inserted between the free end of the handle 22 and the cleaning portion 21. When using the dusting tool, the telescopic part 29 is preferably extracted to increase the useful range of the dusting tool. When storing the dusting tool 20 in the chamber 10, the telescopic part 29 is collapsed such that the dusting tool 20 fits into the chamber 10.

In an embodiment of the dusting system, the outlet is adapted to be connectable with a vacuum cleaner hose (not shown). The outlet may be directly connected, and optionally permanently fixed, to the vacuum cleaner hose such that a vacuum source is provided for the cleaning of the dusting tool in the cleaning compartment.

A dust releasing structure 16 is arranged in the cleaning compartment 11 of the chamber 10 of the embodiment of the dusting system as depicted in FIG. 2. In the content of this inventive concept, a dust releasing structure is a structure against which the fibers of the fibers unit 24, or the cleaning portion 21, are moved during insertion and extraction of the dusting tool 20 into or from the cleaning compartment 11. Thereby dust and particles collected by the dusting tool during cleaning are mechanically released from the dusting tool and can subsequently be removed from the cleaning compartment 11 by means of the air stream caused by the vacuum source. In this embodiment, the dust releasing structure 16 comprises protruding portions which are arranged on the inner wall and extending towards the centre of the cleaning compartment. Alternatively, the protruding portions may be arranged as pins or cams. In another alternative embodiment, the dust releasing structure 16 is arranged as a grid which covers the whole or part of the entry from the cleaning compartment 10 to the outlet channel 12.

In the embodiment as described with reference to FIG. 2, the dust releasing structure 16 is arranged in the cleaning compartment 11 and is further partly extending into the outlet channel 12. The extension of the dust releasing structure 16 into the outlet channel provides an additional effect acting as a guide for particles streams from the cleaning compartment 11. Further, the dust releasing structure, can be partly or solely arranged at other locations of the chamber, e.g. the dust releasing structure may be arranged in the opening, in the outlet channel or at the interface between the cleaning compartment and the storage compartment.

In an embodiment of the dusting system, the materials of the storage compartment 15 or its inner surface 14, and the cleaning portion 21 are selected for providing charging of the cleaning portion 21 with static electricity. This emphasizes the cleaning ability of the dusting tool since the charged cleaning fibers have an increased ability to attract and retain dust particles. Material for the cleaning portion 21 may for instance be a microfiber material such as a polyethylene mix, supplied from Starfiber or Aquastar.

Figure 3:
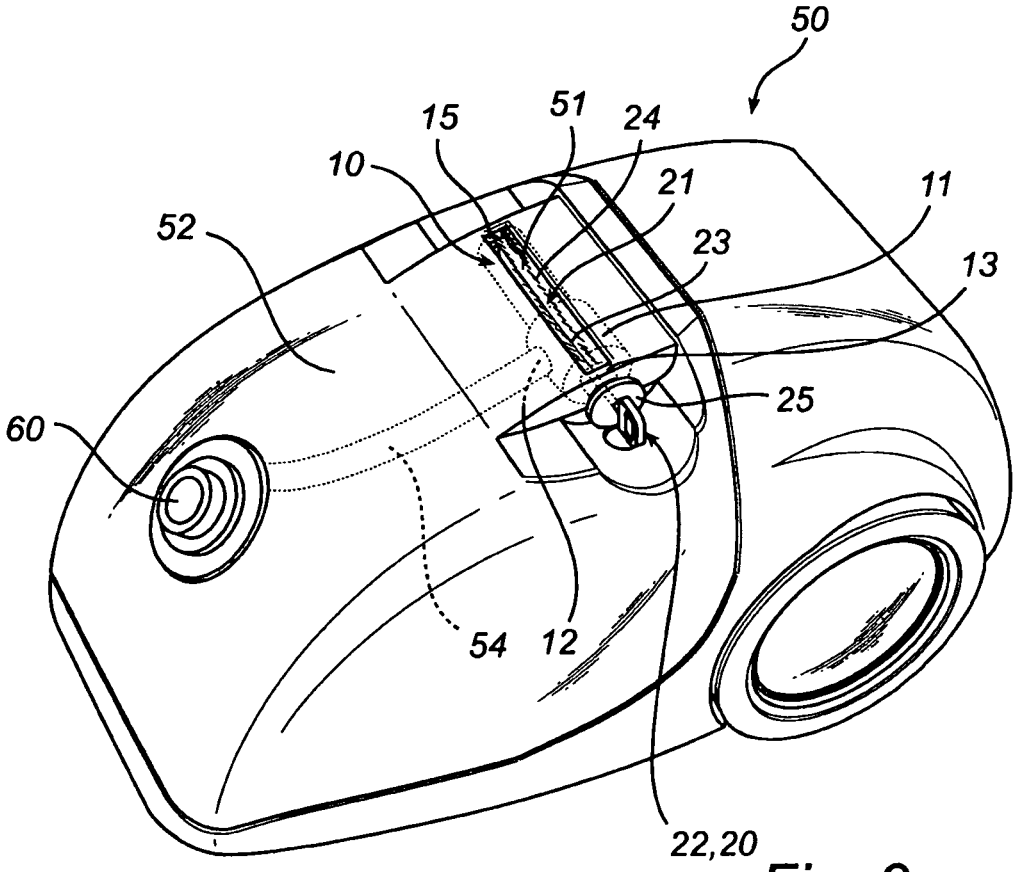
FIG. 3 is a schematic perspective illustration of an embodiment of the dusting system according to the present inventive concept.

FIG. 3 is a schematic perspective illustration of an embodiment of the dusting system according to the present inventive concept arranged in a vacuum cleaner. The dusting system is here arranged in the housing of a vacuum cleaner 50, and more particularly in the front lid of the vacuum cleaner 50. The chamber 10 is arranged on top of the vacuum cleaner 50 such that the dusting tool 20 can be conveniently extracted from and reinserted into the chamber 10 via the opening 13. The handle 22 has a grip which is accessible for the user even when the dusting tool is fully inserted into the chamber 10. The cleaning compartment 11 is arranged at the opening 13 and is further connected to the vacuum source of the vacuum cleaner (not shown) via an outlet channel 12, which here is connected to the dust bag of the vacuum cleaner (not shown) via a channel 54 which take into dock with the vacuum cleaner hose connection 60 which is connected to the dust bag of the vacuum cleaner.

At least a part of the lid 52, which provides an upper wall of the storage compartment 15 and the cleaning compartment 11, is transparent and hence provides a transparent window 51 arranged at the storage compartment 15 to indicate to the user that a dusting tool is included in the vacuum cleaner.

Figures 4A, 4B:
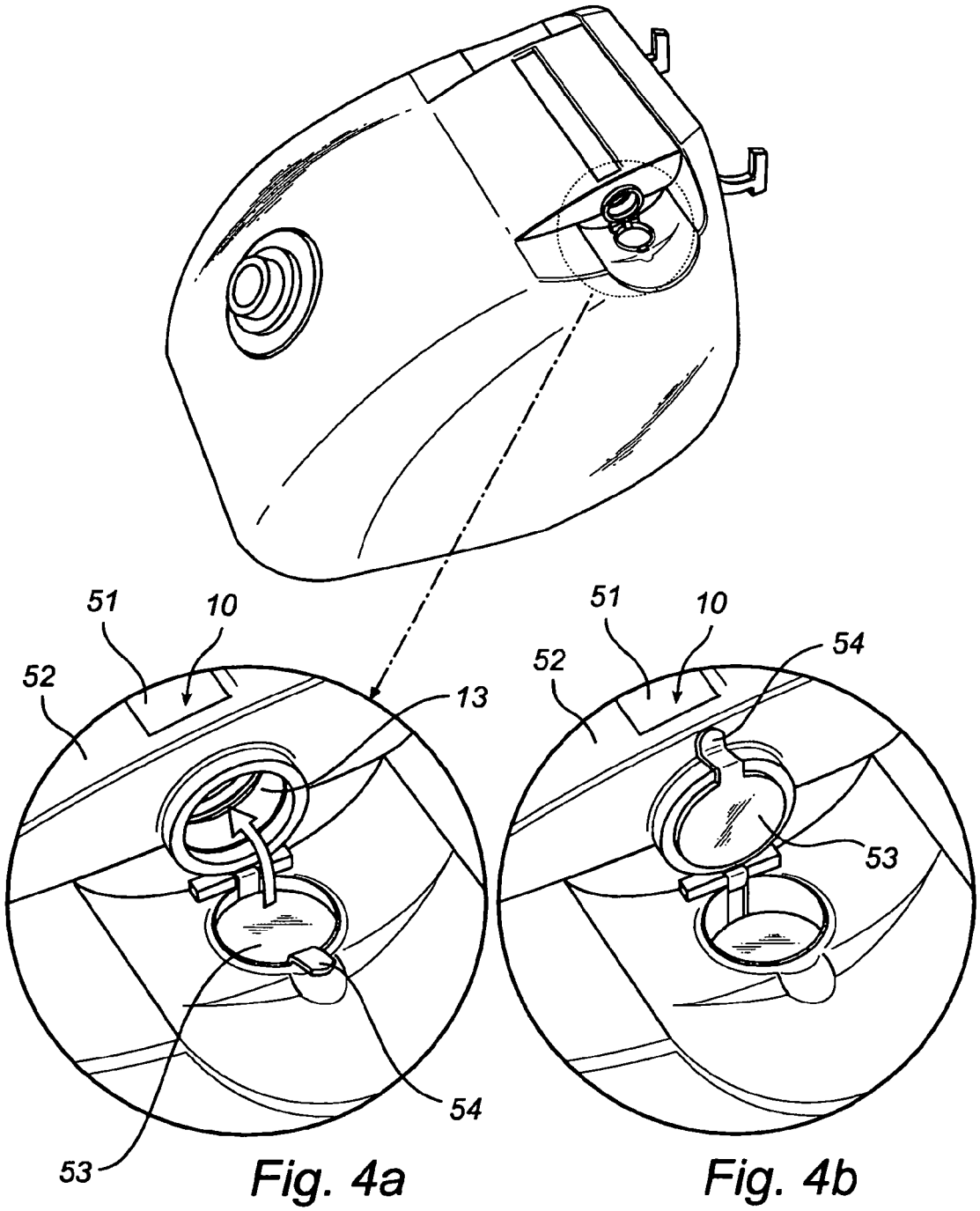
FIGS. 4*a*) and *b*) are close ups schematically illustrating details of an embodiment of a dusting system according to the present inventive concept.

FIGS. 4*a*) and *b*) are close ups schematically illustrating details of an embodiment of a dusting system. The chamber 10 of the embodiment described with reference to FIG. 3 further comprises a second closing element 53 arranged to engage with the opening 13 for providing of an air seal for the chamber 10 when the dusting tool 20 is detached from the chamber 10. The second closing element is a hinged plug 53, which is countersinked into the lid 52 of the vacuum cleaner. A resilient tongue 54 is arranged on the plug locking the plug 53 in a closed position, as illustrated in FIG. 4*b*), as it is folded into the closed position. The material of the plug 53 may be rubber, plastics, metal or any other suitable material.

Above, embodiments of the dusting system according to the present inventive concept as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A dusting system (1) comprising:

a dusting tool (20) with a cleaning portion (21) connected to a handle (22); and an elongated chamber (10) for holding said dusting tool, said chamber comprising an opening (13) for receiving at least said cleaning portion, an outlet channel (12) arranged for enabling fluid communication between said chamber and a vacuum source, and a storage compartment (15) for storing at least a part of said cleaning portion;

said chamber further comprising a cleaning compartment (11) arranged between said opening and said storage compartment, wherein said outlet channel is arranged at said cleaning compartment, thereby enabling cleaning of said cleaning portion upon insertion or extraction of the cleaning portion into or from said storage compartment, wherein said chamber (10) further comprises a dust releasing structure (16), wherein said dust releasing structure (16) is a grid arranged at least partly covering an entry from said cleaning compartment (11) to said outlet channel (12);

wherein said dusting tool (20) comprises a first closing element (25) arranged at said handle (22) which first closing element is arranged to engage with said opening (13) providing an air seal for said chamber (10).

2. A dusting system according to claim 1, wherein said chamber (10) is arranged such that a predetermined ratio between a cross-sectional area of said cleaning compartment (11) in a first plane perpendicular to a longitudinal extension of said chamber and a cross-sectional area of said storage compartment (15) in a second plane perpendicular to the longitudinal extension of said chamber is larger than 1.

3. A dusting system according to claim 1, wherein said storage compartment (15) is arranged to compact said cleaning portion (21).

4. A dusting system according to claim 1, wherein materials for the storage compartment (15) or its inner surface (14), and said cleaning portion (21) are selected for providing charging of said cleaning portion with static electricity.

5. A dusting system according to claim 1, wherein said first closing element (25) is cone shaped.

6. A dusting system according to claim 1, wherein said chamber (10) further comprises a transparent window (51).

7. A dusting system according to claim 1, wherein said outlet channel (12) is adapted to be connectable with a vacuum cleaner hose, a vacuum cleaner tube, or a vacuum cleaner handle.

8. A dusting system according to claim 1, wherein said chamber (10) further comprises a second closing element (53) for providing an air seal for said chamber when said dusting tool (20) is detached from said chamber, said second closing element being arranged to engage with said opening (13) when being actuated.

9. A dusting system according to claim 1, wherein said chamber (10) is adapted to be arranged in a vacuum cleaner housing of a vacuum cleaner (50), and wherein said outlet channel (12) is adapted to be connected to a dust bag or directly to a cyclone unit of said vacuum cleaner.

10. A dusting system according to claim 1, wherein said handle (22) is telescopically extendable.

11. A vacuum cleaner (50) comprising a dusting system according to claim 1.

12. An elongated chamber (10) of a dusting system (1), the chamber comprising:

an opening (13) for receiving a dusting tool (20) comprising a first closing element (25) Which is arranged to engage with said opening (13), an outlet channel (12) arranged for enabling fluid communication between said chamber and a vacuum source, and a storage compartment (15) for storing at least a part of said dusting tool;

said chamber further comprising a cleaning compartment (11) arranged between said opening and said storage compartment., wherein said outlet channel is arranged at said cleaning compartment, thereby enabling cleaning of said dusting tool upon insertion or extraction into or from said storage compartment, wherein said chamber (10) further comprises a dust releasing structure (16) wherein said dust releasing structure is a grid arranged at least partly covering an entry from said cleaning compartment (11) to said outlet channel (12).

13. The elongated chamber (10) according to claim 12, wherein said chamber is arranged such that a predetermined ratio between a cross-sectional area of said cleaning compartment (11) in a first plane perpendicular to a longitudinal extension of said chamber and a cross-sectional area of said storage compartment (15) in a second plane perpendicular to the longitudinal extension of said chamber is larger than 1.

14. The elongated chamber (10) according to claim 12, wherein said first closing element (25) is cone shaped.

15. The elongated chamber (10) according to claim 12, further comprising a transparent window (51).

16. The elongated chamber (10) according to claim 12, wherein said outlet channel (12) is adapted to be connectable with a vacuum cleaner hose, a vacuum cleaner tube, or a vacuum cleaner handle.

17. The elongated chamber (10) according to claim 12, further comprising a second closing element (53) for providing an air seal for said chamber, said second closing element being arranged to engage with said opening (13) when being actuated.

18. The elongated chamber (10) according to claim 12, wherein said chamber (10) is adapted to be arranged in a vacuum cleaner housing of a vacuum cleaner (50), and wherein said outlet channel (12) is adapted to be connected to a dust bag or directly to a cyclone unit of said vacuum cleaner.

19. The elongated chamber (10) according to claim 12, wherein said storage compartment (15) is arranged to compact a cleaning portion (21) of a dusting tool (20).

20. The elongated chamber (10) according to claim 19, wherein materials for the storage compartment (15) or its inner surface (14) are selected for providing charging of said cleaning portion (21) with static electricity.

* * * * *